US008584682B1

(12) United States Patent
Naylor

(10) Patent No.: US 8,584,682 B1
(45) Date of Patent: Nov. 19, 2013

(54) SCARF WITH HAIRPIECE DEVICE

(71) Applicant: Sarah Naylor, Springfield, MA (US)

(72) Inventor: Sarah Naylor, Springfield, MA (US)

( * ) Notice: Subject to any disclaimer, the term of this patent is extended or adjusted under 35 U.S.C. 154(b) by 0 days.

(21) Appl. No.: 13/664,814

(22) Filed: Oct. 31, 2012

(51) Int. Cl.
*A41G 5/00* (2006.01)
*A42B 1/24* (2006.01)

(52) U.S. Cl.
USPC ..... 132/54; 132/53; 2/209.13; 2/209.14; 2/175.3; 2/174

(58) Field of Classification Search
USPC ..... 132/201, 53, 54, 105; 2/207, 209.13, 2/209.14, 174, 175.3; D28/10, 92, 3; D2/500–508
See application file for complete search history.

(56) References Cited

U.S. PATENT DOCUMENTS

| | | | | | |
|---|---|---|---|---|---|
| 2,574,558 | A | * | 11/1951 | Graber et al. | 2/207 |
| 2,730,722 | A | * | 1/1956 | Colangelo | 2/202 |
| 2,889,557 | A | * | 6/1959 | Blair | 2/174 |
| 3,295,536 | A | | 1/1967 | Shaw et al. | |
| 3,460,546 | A | * | 8/1969 | Abbott | 132/53 |
| 3,636,962 | A | * | 1/1972 | Frackowiak | 132/60 |
| 4,492,242 | A | * | 1/1985 | Dalton | 132/53 |
| 4,599,749 | A | * | 7/1986 | Childs et al. | 2/204 |
| 5,170,509 | A | * | 12/1992 | Leopold | 2/195.1 |
| 6,032,292 | A | * | 3/2000 | Wood et al. | 2/207 |
| 6,647,554 | B1 | * | 11/2003 | Yan | 2/209.13 |
| D485,946 | S | | 1/2004 | Angrum | |
| 7,275,270 | B2 | * | 10/2007 | Cotutsca | 2/209.13 |
| D592,832 | S | | 5/2009 | Radell | |
| D605,379 | S | * | 12/2009 | James | D2/866 |
| 7,636,953 | B2 | * | 12/2009 | Grey | 2/207 |
| 7,836,523 | B2 | * | 11/2010 | Castle | 2/207 |
| 2002/0066462 | A1 | * | 6/2002 | Denebeim | 132/275 |
| 2003/0070208 | A1 | * | 4/2003 | Magdziak-Hautala | 2/207 |
| 2005/0278830 | A1 | * | 12/2005 | Hokin | 2/207 |
| 2007/0113319 | A1 | * | 5/2007 | Brinn et al. | 2/174 |
| 2007/0283975 | A1 | * | 12/2007 | Ma | 132/53 |
| 2009/0106878 | A1 | | 4/2009 | Hiskey | |
| 2010/0058515 | A1 | * | 3/2010 | Castle | 2/207 |
| 2010/0170527 | A1 | * | 7/2010 | Toba | 132/201 |
| 2012/0234335 | A1 | * | 9/2012 | Betts | 132/54 |

* cited by examiner

*Primary Examiner* — Robyn Doan
*Assistant Examiner* — Tatiana Nobrega

(57) ABSTRACT

A scarf with hairpiece device has a generally rectangular bandana with a first bandana surface, a second bandana surface, a first bandana side, a second bandana side, a third bandana side, and a fourth bandana side. The bandana has four quadrants. Arc-shaped first attachment means, second attachment means, and third attachment means are located on the first surface in the fourth quadrant offset from one another. A linear fourth attachment is located on the second surface in the first quadrant. A first sunglasses holding component has a strip located on the second surface in the first quadrant. A second sunglasses holding component has a strip located on the second surface in the third quadrant. The sunglasses holding components are attached on a first end and a second end with an open middle for allowing sunglasses legs to pass through.

1 Claim, 6 Drawing Sheets

SCARF WITH HAIRPIECE DEVICE

BACKGROUND OF THE INVENTION

Scarves and hairpieces (or wigs) have existed for centuries with scarves dating back to ancient Rome and hairpieces (or wigs) originating during ancient Egyptian times to protect a wearer's head from the sun. This original utilitarian aspect of scarves and wigs has shifted a large degree toward a more cosmetic use for covering baldness or thinning hair (both natural and health related) as well as for style or entertainment purposes (for example, character portrayal). The present invention features a scarf with hairpiece device having a shape, orientation, and location of the first attachment means, the second attachment means, and the third attachment means critical for the layering and positioning of the posterior hair component(s). The present invention may be especially useful for an individual suffering from hair loss, or just simply having a "bad hair day."

SUMMARY

The present invention features a scarf with hairpiece device comprising a generally rectangular bandana having a first bandana surface, a second bandana surface, a first bandana side, a second bandana side opposed to the first bandana side, a third bandana side, and a fourth bandana side opposed to the third bandana side. In some embodiments, the bandana comprises four quadrants.

In some embodiments, an arc-shaped first attachment means is located on the first surface in the fourth quadrant. In some embodiments, an arc-shaped second attachment means is located on the first surface in the fourth quadrant at an offset. Offset A, from the first attachment means. In some embodiments, an arc-shaped third attachment means is located on the first surface in the fourth quadrant at an offset, Offset B, from the second attachment means.

In some embodiments, a linear fourth attachment is located on the second surface in the first quadrant close to the fourth quadrant.

In some embodiments, a plurality of sunglasses holding components is located on the second bandana surface. In some embodiments, a first sunglasses holding component comprises a first strip located on the second surface in the first quadrant close to the second quadrant. In some embodiments, a second sunglasses holding component comprises a second strip located on the second surface in the third quadrant close to the second quadrant. In some embodiments, the sunglasses holding component is attached on a first end and a second end. In some embodiments, the sunglasses holding component comprises an open middle for allowing a leg of a pair of sunglasses to pass through.

In some embodiments, the bandana is folded along an axis. In some embodiments, the bandana is located on a head of a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

| | |
|---|---|
| 100 | Scarf with hairpiece device |
| 200 | Bandana |
| 210 | First bandana surface |
| 220 | Second bandana surface |
| 230 | First bandana side |
| 240 | second bandana side |
| 250 | Third bandana side |
| 260 | Fourth bandana side |
| 300 | First quadrant dividing line |
| 310 | Second quadrant dividing line |
| 320 | First quadrant |
| 330 | Second quadrant |
| 340 | Third quadrant |
| 350 | Fourth quadrant |
| 360 | Offset A |
| 370 | Offset B |
| 380 | Axis A |
| 390 | Axis B |
| 400 | First attachment means |
| 410 | Second attachment means |
| 420 | Third attachment means |
| 430 | Fourth attachment means |
| 500 | Sunglasses holding component |
| 510 | Sunglasses holding component first end |
| 520 | Sunglasses holding component second end |
| 530 | Sunglasses holding component middle |
| 600 | Anterior hair component |
| 610 | Anterior hair component attachment |
| 620 | Posterior hair component |
| 630 | Posterior hair component attachment |
| 640 | Hair strands |

Figure 1:
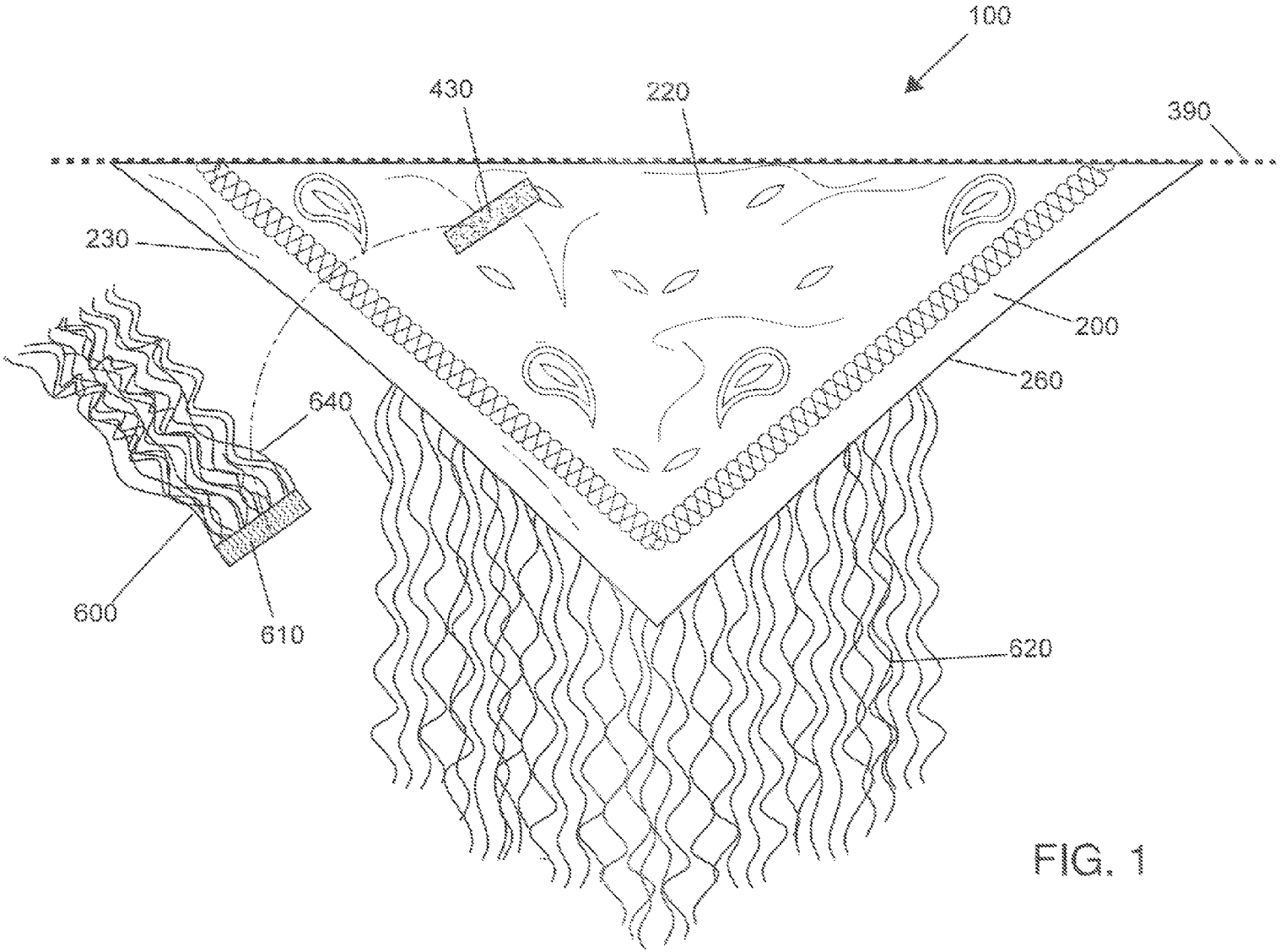
FIG. 1 is a view of the present invention featuring the fourth attachment means.
Figure 2:
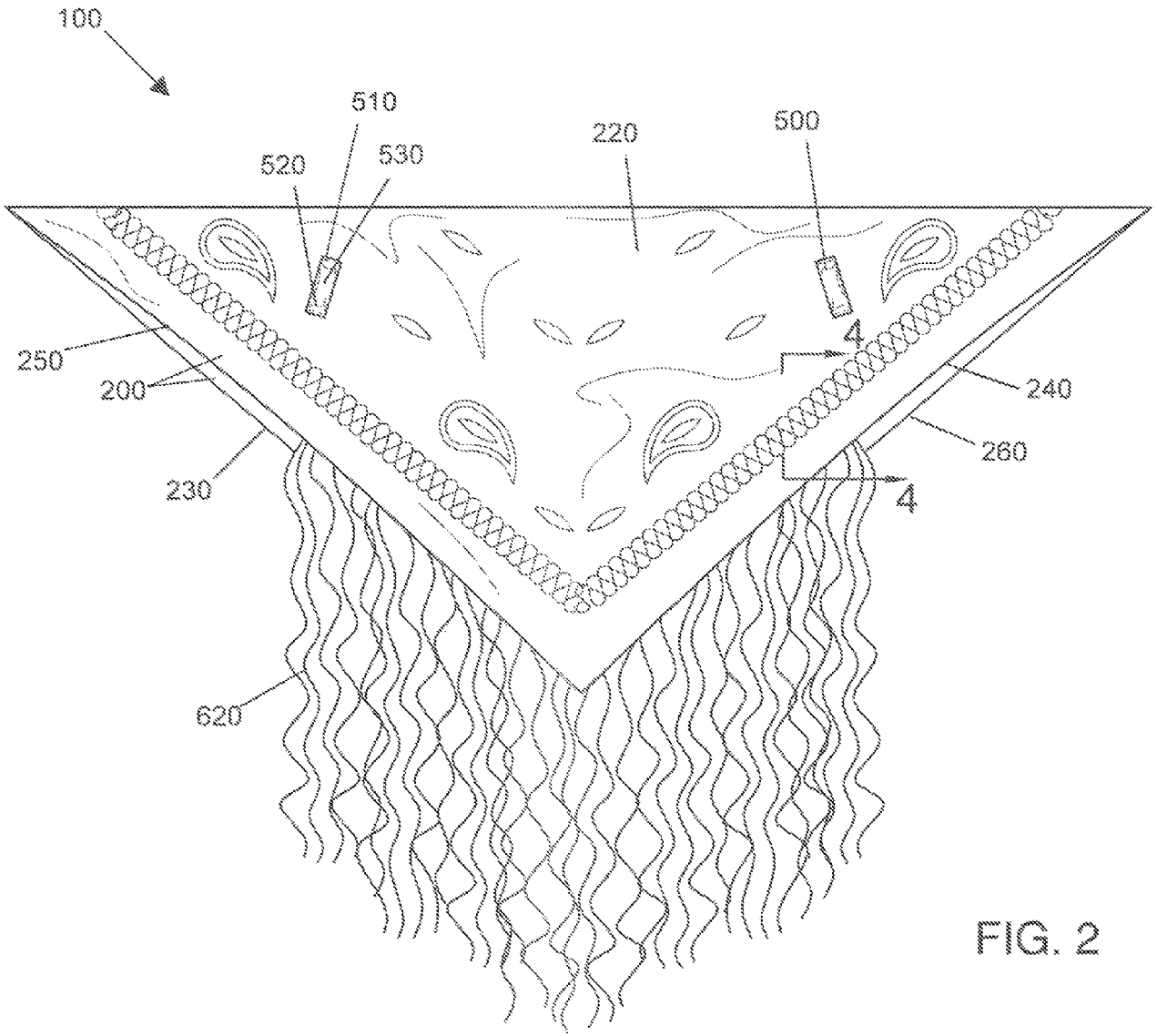
FIG. 2 is a view of the present invention featuring the sunglasses holding component.
Figure 3:
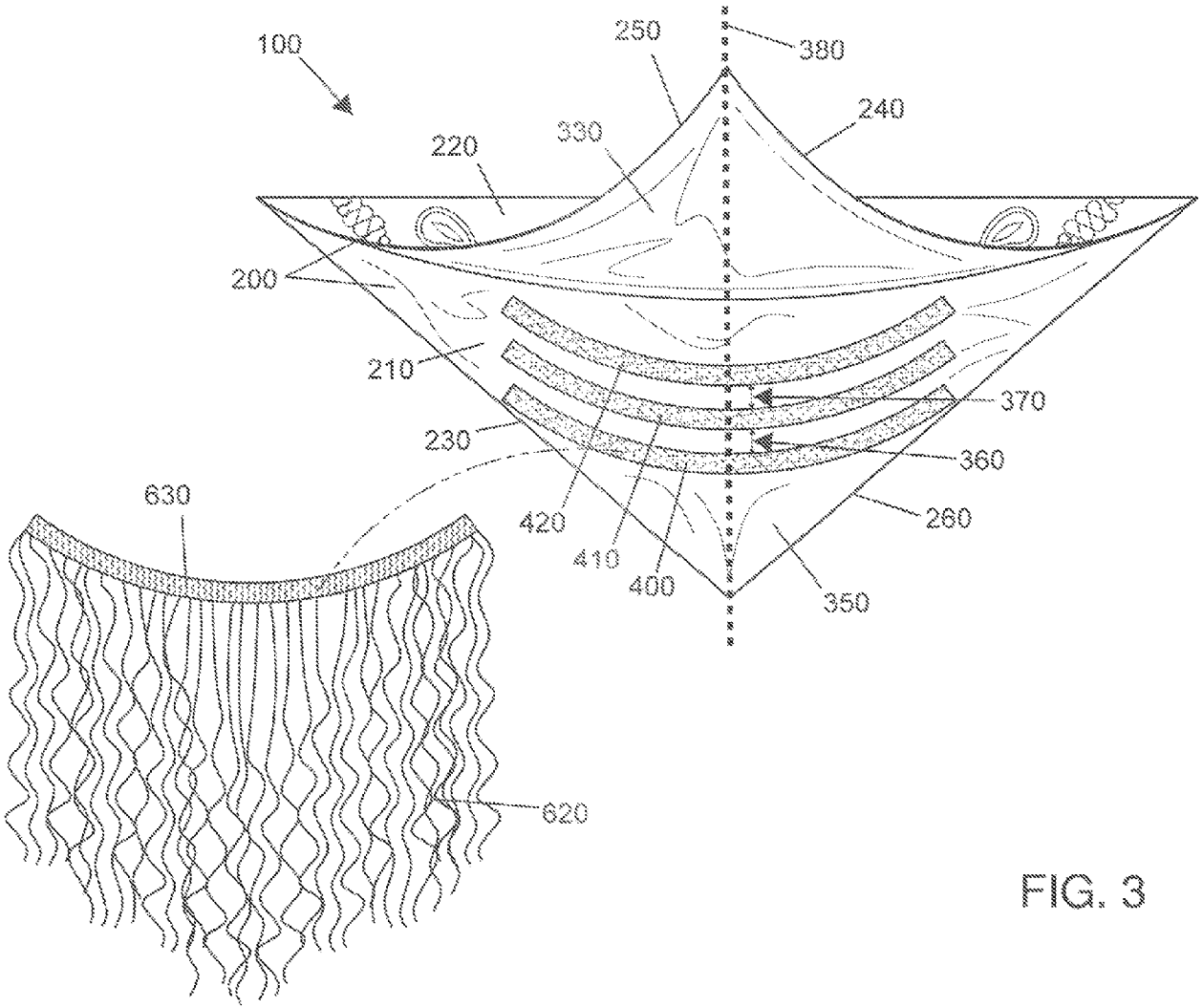
FIG. 3 is a view of the present invention featuring the posterior hair component.
Figure 4:
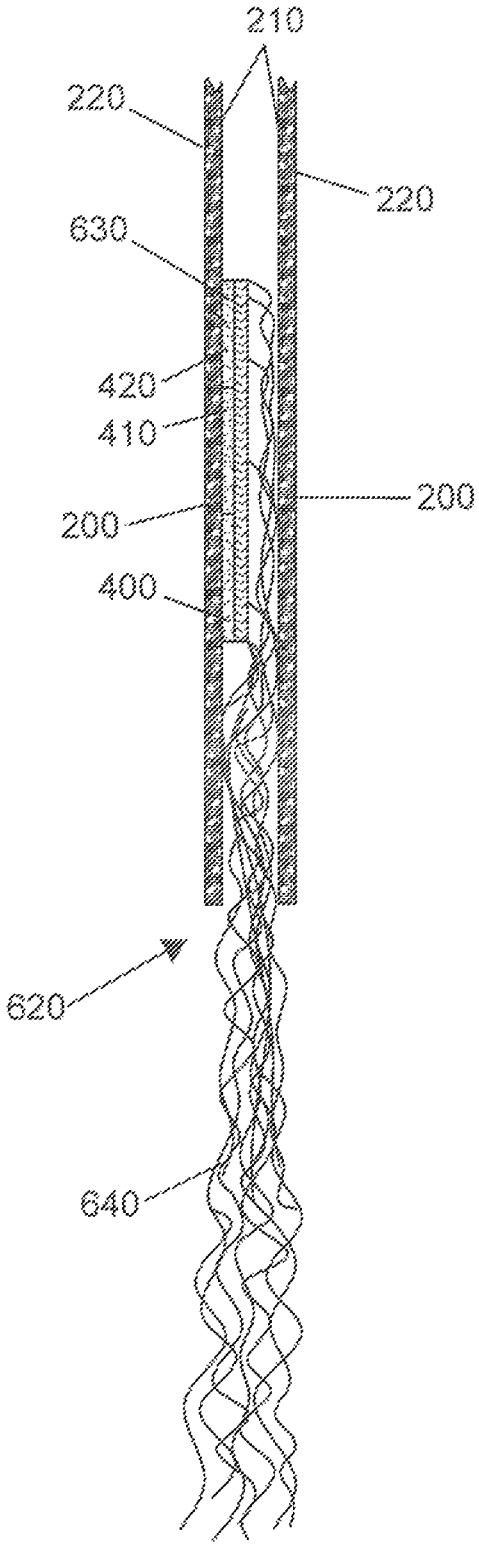
FIG. 4 is a cross-sectional view in a sagittal plane of the present invention.
Figure 5:
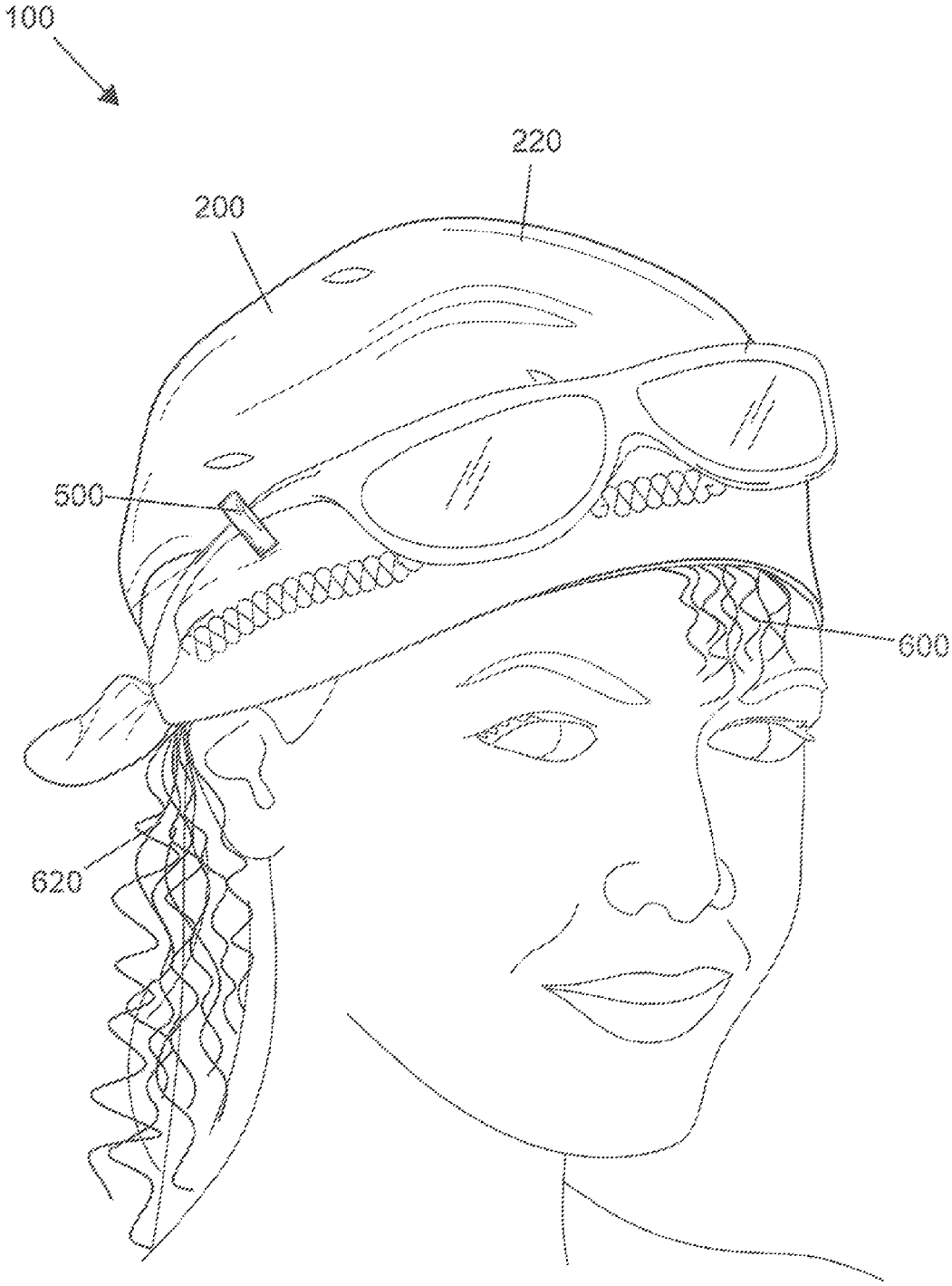
FIG. 5 is a view of the present invention in use.
Figure 6:
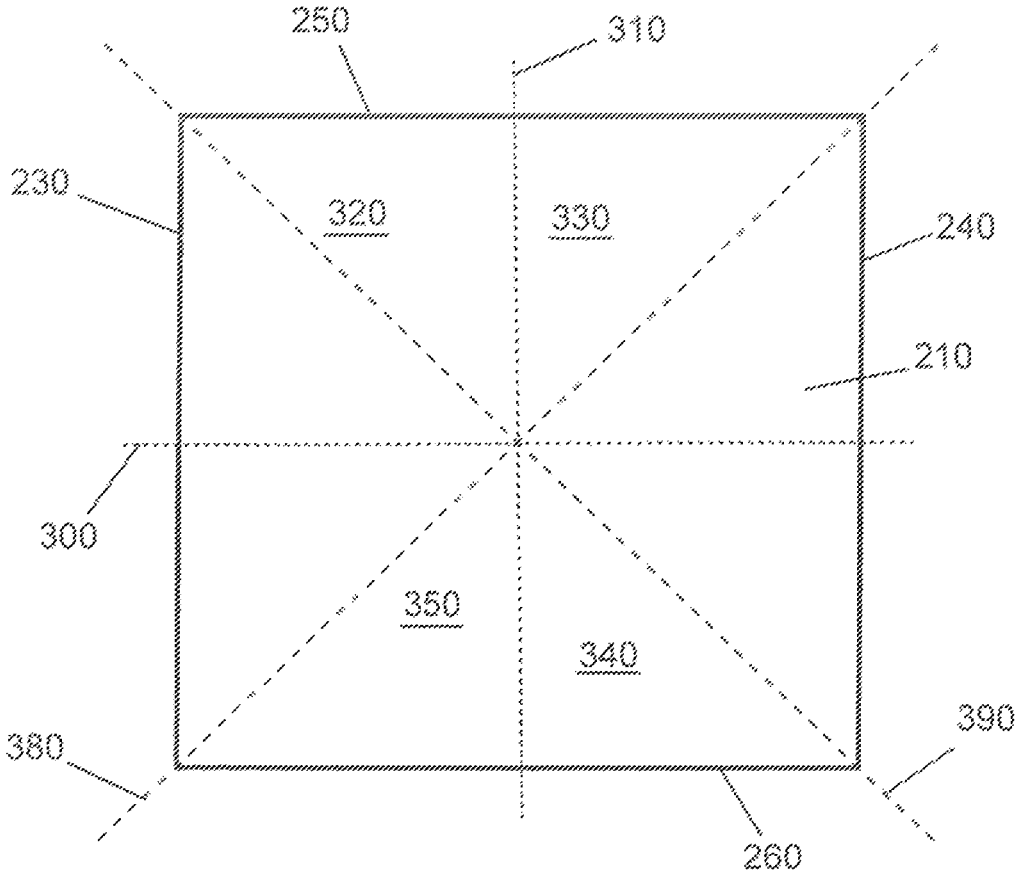
FIG. 6 is a schematic view of the sides, the quadrants, and the axes of the present invention.

Referring now to FIG. 1-6, the present invention features a scarf with hairpiece device (100) having hair (or simulated hair) extending from underneath the scarf for wearing on a head of a user. In some embodiments, the device (100) comprises a generally rectangular bandana (200) having a first bandana surface (210), a second bandana surface (220), a first bandana side (230), a second bandana side (240) opposed to the first bandana side (230), a third bandana side (250), and a fourth bandana side (260) opposed to the third bandana side (250). In some embodiments, the bandana (200) comprises four quadrants.

In some embodiments, a first quadrant dividing line (300) is located from a middle of the first bandana side (230) to a middle of the second bandana side (240) and a second quadrant dividing line (310) is located from a middle of the third bandana side (250) to a middle of the fourth bandana side (260).

In some embodiments, a first quadrant (320) is bordered on two sides by the first bandana side (230) and the third bandana side (250). In some embodiments, a second quadrant (330) is bordered on two sides by a third bandana side (250) and a second bandana side (240). In some embodiments, the third quadrant (340) is bordered on two sides by a second bandana side (240) and a fourth bandana side (260). In some embodiments, a fourth quadrant (350) is bordered on two sides by a fourth bandana side (260) and a first bandana side (230).

In some embodiments, an arc-shaped first attachment means (400) is located on the first bandana surface (210) in the fourth quadrant (350). In some embodiments, an arc-shaped second attachment means (410) is located on the first bandana surface (210) in the fourth quadrant (350) at a first offset (360), from the first attachment means (400). In some embodiments, an arc-shaped third attachment means (420) is located on the first bandana surface (210) in the fourth quadrant (350) at a second offset (370), from the second attachment means (410).

In some embodiments, the first offset (360) is about one-half inch. In some embodiments, the first offset (360) is about one inch. In some embodiments, the first offset (360) is about one and one-haft inches. In some embodiments, the first offset (360) is about two inches. In some embodiments, the first offset (360) is greater than two inches. In some embodiments, the second offset (370) is about one-half inch. In some embodiments, the second offset (370) is about one inch. In some embodiments, the second offset (370) is about one and one-half inches. In some embodiments, the second offset (370) is about two inches. In some embodiments, the second offset (370) is greater than two inches.

In some embodiments, a midpoint of the first attachment means (400) lays on a first axis (380). In some embodiments, the first axis (380) lays on an intersection of the first bandana side (230) and the fourth bandana side (260) and an intersection of the third bandana side (250) and the second bandana side (240). In some embodiments, a midpoint of the second attachment means (410) lays on the first axis (380). In some embodiments, a midpoint of the third attachment means (420) lays on the first axis (380).

In some embodiments, a vertex of the first attachment means (400) is located close to, or towards the intersection of the first bandana side (230) and the fourth bandana side (260). In some embodiments, a vertex of the second attachment means (410) is located close to, or towards the intersection of the first bandana side (230) and the fourth bandana side (260). In some embodiments, a vertex of the third attachment means (420) is located close to, or towards the intersection of the first bandana side (230) and the fourth bandana side (260). In some embodiments, the vertex is the midpoint.

In some embodiments, a linear fourth attachment means (430) is located on the second bandana surface (220) in the first quadrant (320) close to the fourth quadrant (350).

In some embodiments, the device (100) comprises a plurality of sunglasses holding components (500) located on the second bandana surface (220). In some embodiments, a first sunglasses holding component (500) comprises a first strip located on the second bandana surface (220) in the first quadrant (320) close to the second quadrant (330). In some embodiments, a second sunglasses holding component (500) comprises a second strip located on the second bandana surface (220) in the third quadrant (340) close to the second quadrant (330). In some embodiments, the sunglasses holding component (500) is attached on a sunglasses holding component first end (510) and a sunglasses holding component second end (520). In some embodiments, the sunglasses holding component (500) comprises an open sunglasses holding component middle (530) for allowing a leg of a pair of sunglasses to pass through.

In some embodiments, for use, the bandana (200) is folded along a second axis (390). In some embodiments, the second axis (390) lays on an intersection of the first bandana side (230) and the third bandana side (250), and an intersection of the second bandana side (240) and the fourth bandana side (260). In some embodiments, the bandana (200) is located on a head of a user.

In some embodiments, the device (100) comprises an anterior hair component (600) having hair strands (640) located on an anterior hair component attachment (610). In some embodiments, the anterior hair component attachment (610) is located on the fourth attachment means (430).

In some embodiments, the device (100) comprises a posterior hair component (620) having hair strands (640) located on a posterior hair component attachment (630). In some embodiments, the posterior hair component attachment (630) is located on the first attachment means (400).

In some embodiments, the device (100) comprises a posterior hair component (620) having hair strands (640) located on a posterior hair component attachment (630). In some embodiments, the posterior hair component attachment (630) is located on the second attachment means (410).

In some embodiments, the device (100) comprises a posterior hair component (620) having hair strands (640) located on a posterior hair component attachment (630). In some embodiments, the posterior hair component attachment (630) is located on the third attachment means (420).

In some embodiments, the device (100) comprises a first posterior hair component (620) having hair strands (640) located on a first posterior hair component attachment (630) and a second posterior hair component (620) having hair strands (640) located on a second posterior hair component attachment (630). In some embodiments, the first posterior hair component attachment (630) is located on the first attachment means (400), the second attachment means (410), or the third attachment means (420). In some embodiments, the second posterior hair component attachment (630) is located on the first attachment means (400), the second attachment means (410), or the third attachment means (420). In some embodiments, the first posterior hair component (620) and the second posterior hair component (620) are layered.

In some embodiments, the device (100) comprises a first posterior hair component (620) having hair strands (640) located on a first posterior hair component attachment (630), a second posterior hair component (620) having hair strands (640) located on a second posterior hair component attachment (630), and a third posterior hair component (620) having hair strands (640) located on a third posterior hair component attachment (630). In some embodiments, the first posterior hair component attachment (630) is located on the first attachment means (400). In some embodiments, the second posterior hair component attachment (630) is located on the second attachment means (410). In some embodiments, the third posterior hair component attachment (630) is located on the third attachment means (420). In some embodiments, the first posterior hair component (620), the second posterior hair component (620), and the third posterior hair component (620) are layered.

In some embodiments, the first attachment means (400), the second attachment means (410), the third attachment means (420), or the fourth attachment means (430) comprises a component of a hook and loop system. In some embodiments, a first posterior hair component attachment (630), a second posterior hair component attachment (630), a third posterior hair component attachment (630), or an anterior hair component attachment (610), comprises a second mated component of a hook and loop system.

In some embodiments, the shape, orientation, and location of the first attachment means (400), the second attachment means (410), and the third attachment means (420) are critical in this invention for the layering and positioning of the posterior hair component(s) (620).

As used herein, the term "about" refers to plus or minus 10% of the referenced number. For example, an embodiment wherein the scarf is about 10 inches in length includes a scarf that is between 9 and 11 inches in length.

The disclosures of the following U.S. Patents are incorporated in their entirety by reference herein: U.S. Pat. No. D 592,832; U.S. Pat. No. D 485,946; U.S. Patent Pub. No. 2009/0106878; U.S. Patent Pub. No. 2007/0283975; U.S. Pat. No. 7,836,523 B2; and U.S. Pat. No. 3,295,536.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A scarf with hairpiece device (100) having hair or simulated hair extending from underneath the scarf for wearing on a head of a user, wherein said device (100) consists of:

(a) a generally rectangular bandana (200) having a first bandana surface (210), a second bandana surface (220), a first bandana side (230), a second bandana side (240) opposed to the first bandana side (230), a third bandana side (250), and a fourth bandana side (260) opposed to the third bandana side (250), wherein the bandana (200) consists of four quadrants, wherein a first quadrant dividing line (300) is disposed from a middle of the first bandana side (230) to a middle of the second bandana side (240) and a second quadrant dividing line (310) is disposed from a middle of the third bandana side (250) to a middle of the fourth bandana side (260), wherein a first quadrant (320) is bordered on two sides by the first bandana side (230) and the third bandana side (250), wherein a second quadrant (330) is bordered on two sides by a third bandana side (250) and a second bandana side (240), wherein a third quadrant (340) is bordered on two sides by a second bandana side (240) and a fourth bandana side (260), where in a fourth quadrant (350) is bordered on two sides by a fourth bandana side (260) and a first bandana side (230), wherein an arc-shaped first attachment means (400) is disposed on the first bandana surface (210) in the fourth quadrant (350) and a first hair component having hair strands thereon is disposed on the first attachment means, wherein an arc-shaped second attachment means (410) is disposed on the first bandana surface (210) in the fourth quadrant (350) at a first offset (360), from the first attachment means (400) and a second hair component having hair strands thereon is disposed on the second attachment means, wherein an, arc-shaped third attachment means (420) is disposed on the first bandana surface (210) in the fourth quadrant (350) at a second offset (370), from the second attachment means (410) and a third hair component having hair strands thereon is disposed on the third attachment means, wherein a midpoint of the first attachment means (400) lays on a first axis (380), wherein the first axis (380) lays on an intersection of the first bandana side (230) and the fourth bandana side (260) and an intersection of the third bandana side (250) and the second bandana side (240), wherein a midpoint of the second attachment means (410) lays on the first axis (380), wherein a midpoint of the third attachment means (420) lays on the first axis (380), wherein a vertex of the first attachment means (400) is disposed proximal to, or towards the intersection of the first bandana side (230) and the fourth bandana side (260), wherein a vertex of the second attachment means (410) is disposed proximal to, or towards the intersection of the first bandana side (230) and the fourth bandana side (260), wherein a vertex of the third attachment means (420) is disposed proximal to, or towards the intersection of the first bandana side (230) and the fourth bandana side (260), wherein a linear fourth attachment means (430) is disposed on the second bandana surface (220) in the first quadrant (320) proximal to the fourth quadrant (350) and a fourth hair component having hair strands thereon is disposed on the fourth attachment means; and (b) a plurality of sunglasses holding components (500) disposed on the second bandana surface (220), wherein a first sunglasses holding component (500) consists of a first strip disposed on the second bandana surface (220) in the first quadrant (320) proximal to the second quadrant (330), wherein a second sunglasses holding component (500) consists of a second strip disposed on the second bandana surface (220) in the third quadrant (340) proximal to the second quadrant (330), wherein the sunglasses holding component (500) is attached on a sunglasses holding component first end (510) and a sunglasses holding component second end (520), wherein the sunglasses holding component (500) consists of an open sunglasses holding component middle (530) for allowing a leg of a pair of sunglasses to pass through, wherein for use, the bandana (200) is folded along the second axis (390), wherein the second axis (390) lays on an intersection of the first bandana side (230) and the third bandana side (250), and an intersection of the second bandana side (240) and the fourth bandana side (260), wherein the bandana (200) is disposed on a head of a user.

* * * * *